US006276853B1

(12) United States Patent
Breidenbach et al.

(10) Patent No.: US 6,276,853 B1
(45) Date of Patent: Aug. 21, 2001

(54) AXIALLY ALIGNED, COMMONLY JOINED DUAL DISPENSERS

(75) Inventors: Diane Breidenbach; Laurence Mille, both of Smithtown, NY (US)

(73) Assignee: Fragrance Systems International Inc., Hauppauge, NY (US)

( * ) Notice: Subject to any disclaimer, the term of this patent is extended or adjusted under 35 U.S.C. 154(b) by 0 days.

(21) Appl. No.: 09/291,670

(22) Filed: Apr. 14, 1999

(51) Int. Cl.[7] ..... B43K 27/08
(52) U.S. Cl. ..... 401/34; 401/17; 401/18
(58) Field of Search ..... 401/34, 16, 17, 401/18; 222/129, 143, 545; 215/6, 228, 386, 10; 220/23.4, 23.6, 23.86, 380, 212; 132/294, 314; 206/823

(56) References Cited

U.S. PATENT DOCUMENTS

| | | | | |
|---|---|---|---|---|
| D. 164,327 | | 8/1951 | Roehrich | D9/341 |
| D. 241,120 | | 8/1976 | Dekker | D9/504 |
| D. 260,559 | | 9/1981 | Scalice | D28/7 |
| D. 294,804 | | 3/1988 | Lunderman et al. | D9/377 |
| D. 322,391 | | 12/1991 | Morane | D9/300 |
| D. 325,342 | | 4/1992 | Balavich | D9/347 |
| D. 344,017 | | 2/1994 | Lang et al. | D9/504 |
| D. 345,915 | | 4/1994 | Fareri et al. | D9/521 |
| D. 368,427 | | 4/1996 | Bicknell et al. | D9/338 |
| D. 370,088 | | 5/1996 | Burns | D26/86 |
| D. 385,184 | | 10/1997 | Binter | D9/341 |
| D. 390,117 | | 2/1998 | Kan et al. | D9/529 |
| D. 391,166 | | 2/1998 | Lang | D9/504 |
| 2,264,482 | | 12/1941 | Ridner, Sr. . | |
| 3,156,272 | * | 11/1964 | Indrunas | 141/286 |
| 3,335,854 | | 8/1967 | Landen . | |
| 3,696,919 | | 10/1972 | Miles et al. | 20/47 A |
| 3,856,138 | | 12/1974 | Maekawa et al. | 206/221 |
| 4,133,445 | | 1/1979 | Mandelbaum | 220/23.4 |
| 4,170,082 | | 10/1979 | Freedman | 46/29 |
| 4,174,035 | | 11/1979 | Wiegner | 206/222 |
| 4,196,808 | | 4/1980 | Pardo | 206/432 |
| 4,300,681 | | 11/1981 | Klygis et al. | 206/428 |
| 4,377,234 | | 3/1983 | Kaplan | 206/432 |
| 4,542,930 | | 9/1985 | Adams | 294/160 |
| 4,614,267 | | 9/1986 | Larkin | 206/221 |
| 4,690,276 | | 9/1987 | Sussman | 206/36 |
| 4,690,673 | | 9/1987 | Bloomquist | 604/67 |
| 4,872,774 | * | 10/1989 | Rosso | 401/29 |
| 4,993,860 | | 2/1991 | Sommer | 401/214 |
| 5,158,191 | | 10/1992 | Douglas | 215/10 |
| 5,174,460 | | 12/1992 | Minnette | 215/335 |
| 5,314,067 | | 5/1994 | Strock | 206/430 |
| 5,316,159 | | 5/1994 | Douglas et al. | 215/10 |

(List continued on next page.)

OTHER PUBLICATIONS

Caroline Herrera, "212" fragrance bottle, one page advertisement and Applicant's sketch of the interior of the Carolina Herrera dispenser, one page.
Carolina Herrera "212" Fragrance bottle of Carolina Herrera, New York, NY 1 page advertisement and 1 page internal diagram, 1998.
"Kiss & Tell" Apr. 1999 1 page advertisement (same as US patent no. 5,803,268 of Levy.

*Primary Examiner*—Gregory L. Huson
*Assistant Examiner*—Peter de Vore
(74) *Attorney, Agent, or Firm*—Alfred M. Walker

(57) ABSTRACT

A liquid dispenser for dispensing liquids such as perfumes or other fragrances includes a common double-ended cap with a plurality of liquid dispensers bottles therein. Each of the dispensing bottles is retained in axial alignment with another of the bottles within the common double-ended cap. Each bottle has a dispensing end facing another dispensing end of another bottle within the common double ended cap. The common double-ended cap preferably includes separate caps attachable at common edges to form a single cap.

8 Claims, 3 Drawing Sheets

U.S. PATENT DOCUMENTS

| | | | | |
|---|---|---|---|---|
| 5,338,123 | * | 8/1994 | Obersteller et al. | 401/34 |
| 5,464,110 | | 11/1995 | Heyworth | 215/223 |
| 5,469,980 | | 11/1995 | O'Meara | 215/228 |
| 5,525,299 | | 6/1996 | Lowe | 422/99 |
| 5,526,960 | | 6/1996 | Breidenbach et al. | 222/183 |
| 5,586,694 | | 12/1996 | Breidenbach et al. | 222/183 |
| 5,590,780 | | 1/1997 | O'Meara | 206/520 |
| 5,652,143 | | 7/1997 | Gombrich et al. | 435/304.2 |
| 5,655,554 | * | 8/1997 | Goldberg | 132/314 |
| 5,738,067 | | 4/1998 | Landwehr et al. | 132/320 |
| 5,799,838 | | 9/1998 | Miller | 222/480 |
| 5,803,268 | | 9/1998 | Levy et al. | 206/581 |
| 5,810,495 | | 9/1998 | McAuley | 401/214 |
| 5,813,529 | | 9/1998 | Goserud | 206/315.1 |
| 5,833,654 | | 11/1998 | Powers et al. | 604/93 |
| 5,862,949 | | 1/1999 | Markey et al. | 222/143 |
| 5,881,742 | * | 3/1999 | Hunsberger | 132/297 |
| 5,884,678 | * | 11/1964 | Chudy | 141/319 |
| 5,897,262 | * | 4/1999 | Bratby-Carey | 401/18 |
| 5,897,265 | | 4/1999 | Wilson | 401/199 |

* cited by examiner

AXIALLY ALIGNED, COMMONLY JOINED DUAL DISPENSERS

FIELD OF THE INVENTION

The present invention relates to liquid dispensers for a plurality of liquids.

BACKGROUND OF THE INVENTION

Dual liquid dispensers for a plurality of liquids, such as fragrances, are known. For example, U.S. Pat. No. 5,803,268 of Levy describes a double ended perfume bottle. However, in Levy '268 the two liquid dispensers are permanently attached, in that a smaller bottle sits entirely within a larger bottle. In addition, the dispensing ends face away from each other at the opposite ends of the barrel, which requires the necessity for two leakproof caps, one at each end of the barrel.

Therefore, in Levy '268, the two dispensers are not closed by a common cap therebetween, and the dispensing ends do not face each other.

In another embodiment for a dual fragrance container of Carolina Herrera known as "212", two fragrance spray bottles with globed bottoms face inside a common cap, but the dispensing spray nozzles are not axially aligned within the common cap. In fact, the spray nozzles are obliquely placed within the common cap, away from the axis of the cylindrical cap.

Other dual liquid dispensers disclose two dispensers laid in a side by side relationship, wherein the two dispensers are commonly joined along common longitudinally extending edges.

Among such side by side dual dispensers include U.S. Pat. No. 4,133,445 of Mandelbaum for a pill dispenser, U.S. Pat. No. 4,174,035 of Wiegner for a two component container, U.S. Pat. No. 4,196,808 of Pardo for a closure interlock and packaging system, U.S. Pat. No. 4,377,234 of Kaplan for a multiple compartment banding sleeve, U.S. Pat. No. 4,614,267 of Larkin for a dual compartmented container, U.S. Pat. No. 4,690,276 of Sussman for a container for cosmetic sundries, U.S. Pat. Nos. 5,158,191 and 5,316,159, both of Douglas et al for dual bottle containers, and Pat. No. Des. 385,184 of Binter for a multiple part container with a common cap.

U.S. Pat. No. 3,856,138 of Markawa discloses like Levy '268 one container inside another, but they have the same dispensing end. However, such placement configuration requires that a portion of each dispenser be flattened to accommodate the side by side placement.

Other prior art includes U.S. Pat. No. 4,300,681 of Klygis et al for a cap for holding a plurality of beverage bottles in a side by side relationship, U.S. Pat. No. 4,170,082 of Freedman for joinable square plates having round holes for holding cylindrical containers therefrom and U.S. Pat. No. 5,314,067 of Strock for sleeves for holding beverage bottles in an end to end linearly extending configuration.

However, the prior art does not disclose an easily assembled, axially aligned, commonly joined dual dispenser for a plurality of liquids.

OBJECTS OF THE INVENTION

Therefore, it is an object of the present invention to provide an easily assembled, axially aligned, commonly joined dual dispenser for a plurality of liquids.

It is another object of the present invention to provide a common cap for a plurality of liquid dispensers.

It is yet another object of the present invention to store a pair of dispensing bottles in a linear head-to-head arrangement within a single, common cap.

It is a further object of the present invention to nest a pair of fragrance bottles within a cap having a plurality of colored indicia indicative of each fragrance within each respective fragrance bottle.

It is another object of the present invention to produce a single bottle cap from a plurality of pieces.

It is yet still another object of the present invention to provide a snap joint for a common cap for a plurality of dispensers wherein the joint is friction retentive.

It is another object of the present invention to improve over the disadvantages of the prior art.

SUMMARY OF THE INVENTION

In keeping with these objects and others which may become apparent, the present invention includes a system for axially storing a pair of liquid dispenser bottles within a common cap. The bottles may be inserted within respective docking sleeves in a linear head-to-head arrangement. Each docking sleeve includes a pair of hollow nesting portions into which each dispenser bottle is inserted.

The liquid dispensers can dispense liquid from a variety of ways, such as through a roller ball nozzle, a spray nozzle, pump or other pouring arrangement.

While a single bottle cap may be produced for the pair of dispenser bottles, wherein nesting portions are provided at opposite ends of the single bottle cap, in the preferred embodiment, the single bottle cap is actually a pair of separate bottle caps which attach together to form a single bottle cap. Such a configuration is actually simpler to manufacture than manufacturing a single sleeve with two separate nesting portions being inserted therein. In this preferred embodiment the tops of two separate bottle caps are removed, exposing a pair of top edges which mate together to form a single bottle cap with a common, seamed edge.

While the two cap portions can be joined by a threaded means, such as male threaded portion being inserted into a female threaded portion, in the preferred embodiment the fit is a snap fit, since it is not necessary to repeatedly loosen and tighten the two pieces of the bottle cap once it is assembled together.

Therefore the snap fit can include a protecting flanged boss in one bottle cap portion and a female receptacle in the other bottle cap portion. The flanged boss may be a projecting tab or a an annular ring, or other suitable configuration. In addition, the snap fit may be at least one latch member, projecting upwards and insertable within a recess having at least one undercut to receive the latch member therein.

Therefore, when two different types of fragrances are provided in the two dispenser bottles, the common cap between the two dispenser bottles can be made of two separate colors to designate the two types of fragrances in the respective pair of bottle dispensers. In case the perfume or other liquids are indistinguishable from each other, the two dispenser bottles could be color coordinated with their respective colored cap portions, by having a similar color dot or annular ring imprinted upon a portion of the exterior of each dispenser bottle.

BRIEF DESCRIPTION OF THE DRAWINGS

The present invention can best be understood in conjunction with the accompanying drawings, in which.

DETAILED DESCRIPTION OF THE INVENTION

Figure 1:
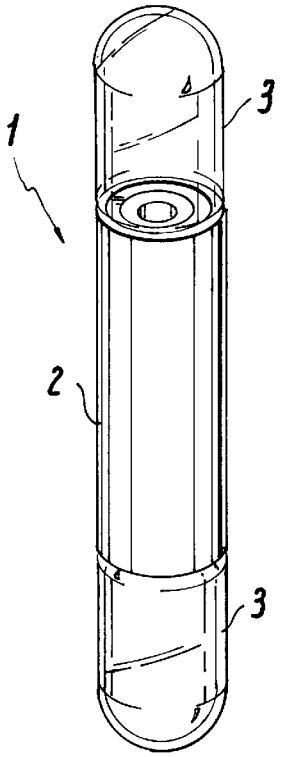
FIG. 1 is a perspective view of a perfume dispenser having two roller ball applicators with containers having hemispherical bottoms.

FIG. 1 shows a liquid dispenser 1, for liquids, such as perfumes or other fragrances, or for pharmaceutical products, including a common double-ended cap 2 with transparent or translucent glass 3 having hemispherical ends. The applicator bottles may have roller ball applicator bottles as shown or may optionally include spongy dab on dispensers, spray nozzles, pump applicators, pouring spouts or other types liquid applicator means.

Figure 2:
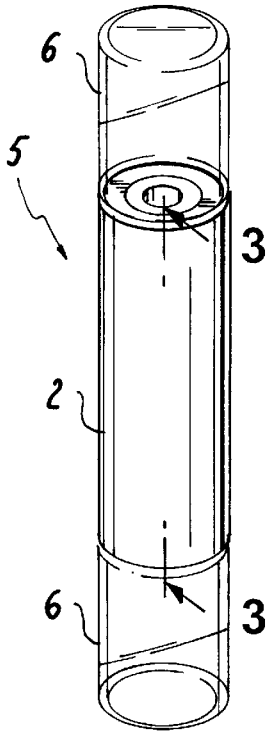
FIG. 2 is a perspective view of a perfume dispenser having two roller ball applicators with containers having flat bottoms.

FIG. 2 is a similar view of a similar dispenser 5 that uses transparent or translucent dispensing bottles 6 having a flat end.

Optionally, the ends may be opaque.

Figure 3:
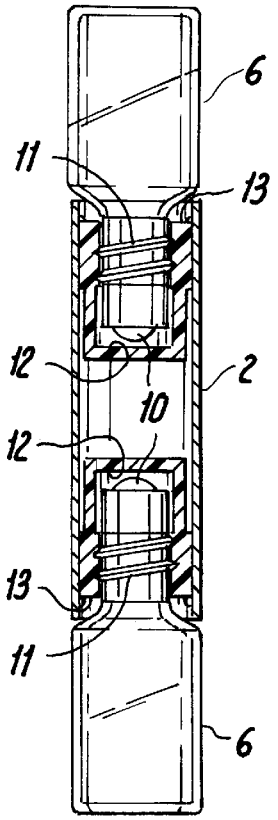
FIG. 3 is a side view with central parts in cross section of first embodiment of a perfume dispenser.

FIG. 3 is a side view of the dispenser 5 with the central section in cross section at a plane indicated by A—A in FIG. 2. Each of the dispensing bottles 6 screws into a common threaded cap bottle receptacle 12 of a docking sleeve, such as common cap 2, that receives threads 11 of dispensing bottle 6. The roller ball applicators 10 are thereby sealed by cap receptacles 12 within common cap 2, such as a docking sleeve. Caps 12 are adhesively bonded at 13 within decorative metal or plastic docking sleeve 2.

Figure 3A:
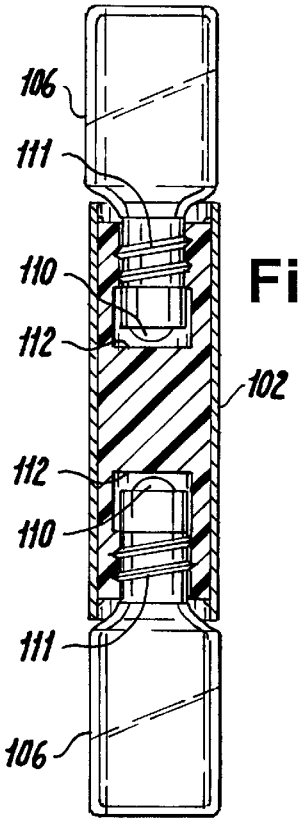
FIG. 3A is a side view with central parts in cross section of another embodiment of a perfume dispenser.
Figure 3B:
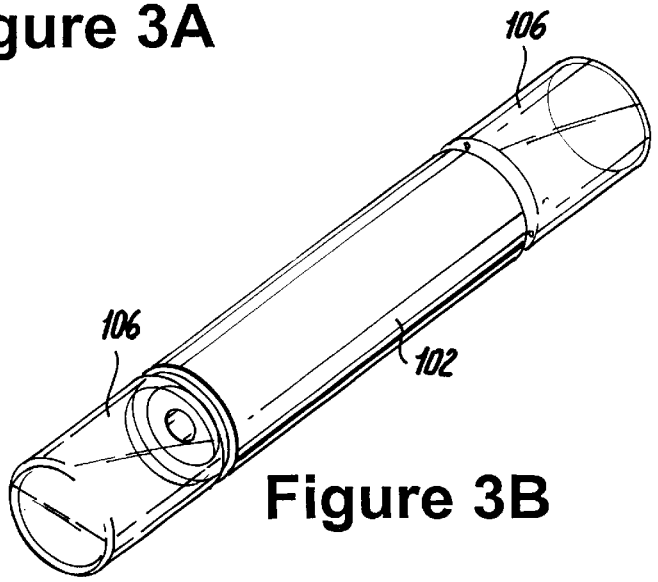
FIG. 3B is a perspective view thereof.

The alternate embodiment of FIGS. 3A and 3B includes a cylindrical docking sleeve 102 molded from a single piece of plastic, and receptacles 112 for retaining bottles 106 are hollowed out and molded into the interior of the docking sleeve 102. Each of the dispensing bottles 106 screws into respective common threaded cap bottle receptacles 112 built into docking sleeve 102. Receptacles 112 receives threads 111 of dispensing bottles 106. The roller ball applicators 110 are thereby sealed by cap receptacles 112 within docking sleeve 102.

While this embodiment of FIGS. 2 and 3 presents an attractive package, unless identification is printed on the dispensing bottles 6 or the perfume within is of a different hue, it is difficult to distinguish one from the other. Also, the cost of the separate docking sleeve 2 and the assembly cost of bonding cap receptacles 12 within common cap 2 can be avoided with a different configuration.

Figure 4:
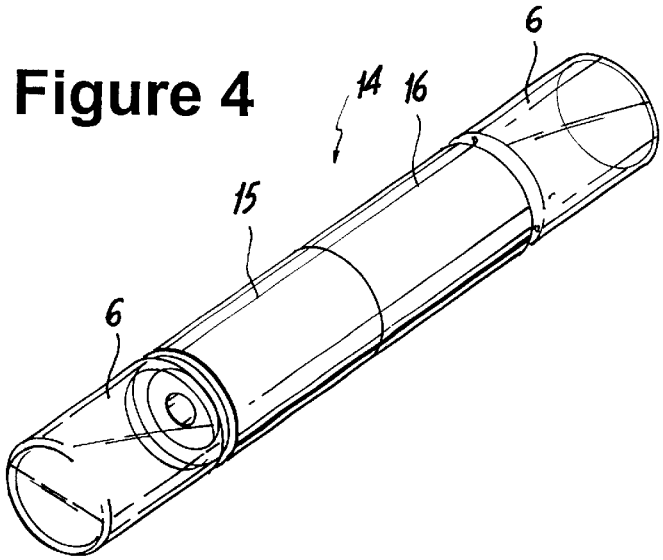
FIG. 4 is a perspective view of a preferred embodiment of a perfume dispenser with a common cap formed from a pair of joinable cap portions, shown in a horizontal position.
Figure 4A:
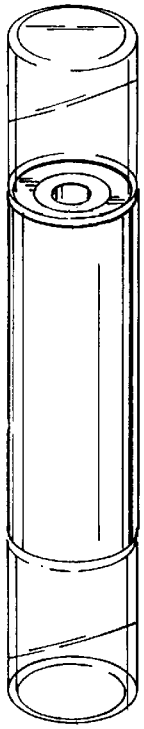
FIG. 4A is a perspective view of thereof in an upright position.
Figure 4B:
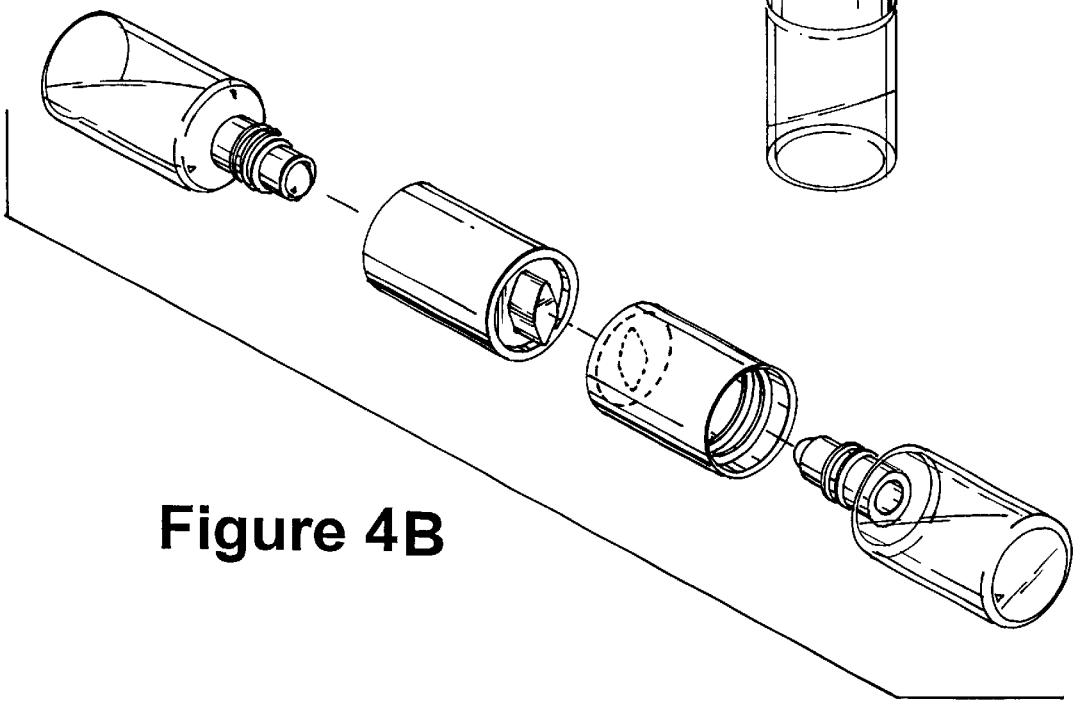
FIG. 4B is an exploded view of the embodiment as in FIG. 4.

FIG. 4 shows a liquid dispenser 14 of the preferred embodiment. Separate fit-together cap receptacles 15 and 16 are attached in a single cap as shown by methods to be discussed. Applicator dispenser bottles 6 simply screw into fit-together cap receptacles 15 and 16 as before. The fit-together bottle cap receptacles 15 and 16 have respective tops and bottoms. The tops have means thereon for mutual attachment therebetween to for attaching the pairs of dispensing bottles 6 in a linear head-toward-head arrangement. The bottoms thereof are respectively provided with female receptacles 22 to receive the male attachment means on respective upper shoulders of dispenser bottles 6.

There is no need for a separate central docking sleeve such as common cap docking sleeve 2 of the previous embodiment. Also, fit-together cap receptacles 15 and 16 can be molded in different colors to differentiate the liquids therein, such as different perfume types.

Figure 5:
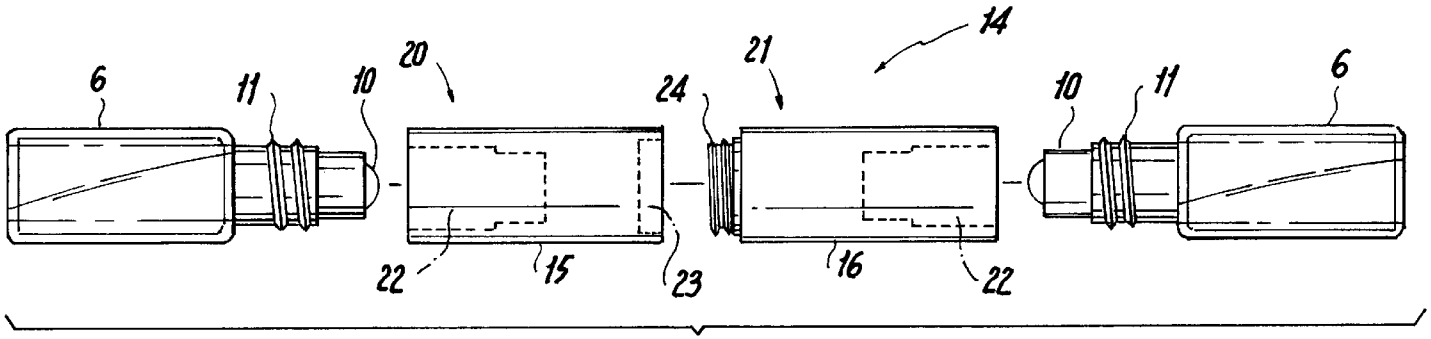
FIG. 5 is an exploded side view of a perfume dispenser showing a threaded attachment method.

FIG. 5 is an exploded view of liquid dispenser 14 showing an attachment method whereby fit-together bottle caps 20 and 21 are joined together by screwing male threaded means 24 of bottle cap 21 into female threaded means 23 of bottle cap 20. Further threaded recesses 22 accept perfume applicator bottles 6. In FIG. 5, the top of one bottle cap 21 has male threaded means 24 and the top of the other bottle cap 20 is provided with female threaded means 23. The bottoms of each cap 20, 21 are provided with further threaded receptacles 22 for receiving the respective threaded upper shoulders of liquid dispenser bottles 6 therein.

If desired, a drop of adhesive on threads 24 or an interference fit of threads 24 and 23 are used to keep caps 20 and 21 permanently attached once assembled into a single unit.

Figure 6:
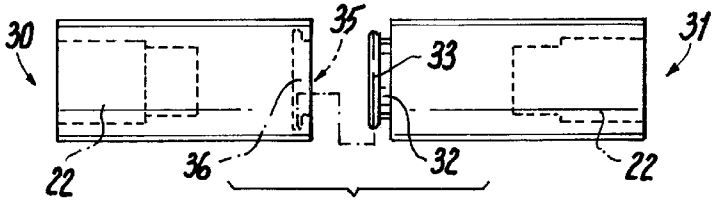
FIG. 6 is a side exploded view of a pair of joinable bottle caps showing a snap-together attachment method.

FIG. 6 shows a preferred embodiment with fit-together caps 30 and 31 for a liquid dispenser of type 14. These caps 30 and 31 are assembled into a single common cap unit by applying end forces such that they snap axially together in friction retention. Projecting flanged boss 33 with undercut neck 32 fits into cavity undercut 36 through opening 35. Boss 33 has a rounded front edge to facilitate assembly with a flat step surface 34 to engage cap 30. Because undercut ring 36 may be difficult to mold, a post molding machine cutting step is sometimes used. This attachment method also has a tendency to rotate. Therefore, if a permanent joint is desired, a small amount of adhesive may be used in assembly to prevent this.

Although no drawing figure is shown for the following embodiment, another attachment method is adhesive bonding of two cap ends similar to those shown in FIG. 6 but eliminating the need for boss 33 in cap 31 and the difficult undercut 36 in cap 30.

Figure 7:
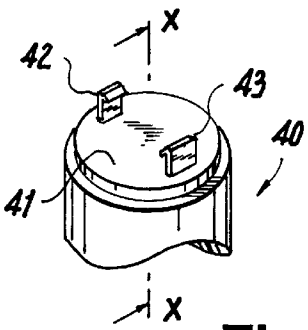
FIG. 7 is a perspective view of a bottle cap showing a latch member of a preferred attachment method; and, FIG. 8 is a side view in cross section of bottle caps in latched configuration of the preferred attachment method.

FIG. 7 is a view of another preferred embodiment for a common cap 40 for a pair of liquid dispensers therein, with at least one latch member of one liquid dispenser retaining cap engageable with at least one undercut of another liquid dispenser retaining cap, such as a pair of protruding latch members 42 and 43 in cap 40 engageable with undercuts 48, 49 of cap 45.

Figure 8:
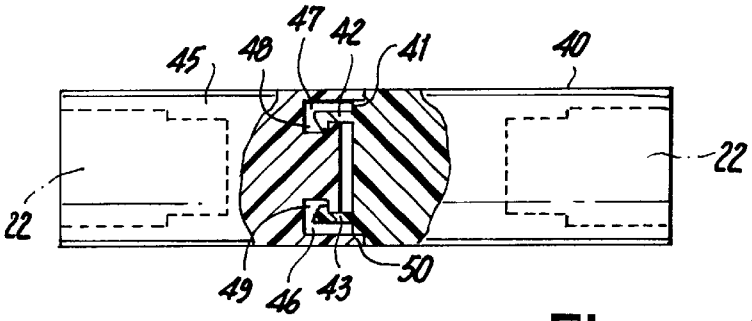

Along with common cap 45, this assembly of cap 40 is shown in cross section, at plane X—X in FIG. 8, which is the preferred mutual attachment method for dispensers of type 14, as shown in FIG. 4. Latch member 43 is wider than latch member 42 to provide a positive outer surface alignment of caps 40 and 45 when assembled, so that they won't fit the wrong way. This is important if the caps 40 and 45 are separately printed or decorated. Caps 40 and 45 can then be assembled with the assurance that the printing would be aligned. Cap 40 has a stepped boss to provide axial alignment with the recess formed by circular extension 50 of cap 45. Cap 45 has two rectangular stepped recesses 46 and 47 with undercuts 48 and 49 to mate with latch members 42 and 43. These rectangular recesses 46 and 47 with undercuts 48 and 49 are routinely molded in most resins using well known techniques.

The contact surfaces of latch members 42 and 43 with the undercut edges in cap 45 have a slight angle to help force the two caps into intimate contact at their common outer seam. This assembly method is preferred because it is simple to manufacture, insures surface alignment, affords quick snap-fit assembly, offers twist resistance, and does not involve the use of adhesives.

While the drawing FIGS. 1–8 show embodiments which portray a generally cylindrical configuration with the caps and liquid dispensers having a substantially cylindrical shape with uniform diameters, in other configurations the caps and liquid dispensers can be tapered, such as being conical or in an hour glass type configuration, with substantially non-cylindrical but uniform external contours.

It is further noted that other modifications may be made to the present invention without departing from the scope as noted in the appended claims.

We claim:

1. A liquid dispenser comprising a common double-ended cap with liquid dispenser bottles extending from opposite sides of said cap each of said bottles retained in axial alignment with another of said bottles, each said bottle having a dispensing end facing a dispensing end of said other bottle within said common double ended cap; wherein said common double-ended cap comprises separate caps attachable and separable at common edges; wherein said separate caps are rigid, forming an uninterrupted common double-ended cap and, wherein each said liquid dispenser bottle includes a roller ball applicator.

2.The liquid dispenser as in claim 1 wherein said bottles are retained axially within threaded receptacles located within said common double-ended cap.

3. The liquid dispenser as in claim 1 wherein said caps are joined together by screwing male threads of one cap into female threads of another cap.

4. The liquid dispenser as in claim 1 wherein said caps are joined together by a projecting boss of one cap snapping into a female receptacle of another cap.

5. The liquid dispenser as in claim 4 wherein said boss includes an undercut neck fitting into a cavity undercut through an opening in said receptacle.

6. The liquid dispenser as in claim 1 wherein one cap includes a pair of protruding latch members insertable within corresponding recesses of the other cap of said pair of joinable caps.

7. The liquid dispenser of claim 1 wherein said bottles are provided with differing decorative colors to distinguish their contents.

8. A liquid dispenser comprising a common double-ended cap with a plurality of liquid dispensers bottles therein, each of said bottles retained in axial alignment with another of said bottles within said common double-ended cap, each said bottle having a dispensing end facing another dispensing end of said other bottle within said common double ended cap; wherein said common double-ended cap comprises separate caps joined by adhesive at common edges; and, wherein said separate caps are rigid, forming an uninterrupted common double-ended cap.

* * * * *